United States Patent [19]

Zurcher

[11] 4,079,197

[45] Mar. 14, 1978

[54] VOICE TRANSCODER IN HELIUM ATMOSPHERE

[76] Inventor: Jean-Frederic Zurcher, 10, rue du Dauphine, 22300 Lannion, France

[21] Appl. No.: 741,407

[22] Filed: Nov. 12, 1976

[30] Foreign Application Priority Data

Nov. 19, 1975 France ..... 75 36067

[51] Int. Cl.[2] ..... G10L 1/00

[52] U.S. Cl. ..... 179/1 SH; 179/15.55 T; 179/15.55 R

[58] Field of Search ..... 179/1 SH

[56] References Cited

U.S. PATENT DOCUMENTS

| | | | |
|---|---|---|---|
| 3,600,515 | 8/1971 | Carpenter | 179/1 SH |
| 3,863,026 | 1/1975 | Dildy | 179/1 SH |

FOREIGN PATENT DOCUMENTS

| | | | |
|---|---|---|---|
| 1,187,536 | 4/1970 | United Kingdom | 179/1 SH |

*Primary Examiner*—Kathleen H. Claffy
*Assistant Examiner*—E. S. Kemeny
*Attorney, Agent, or Firm*—Bierman & Bierman

[57] ABSTRACT

A voice transcoder for use in compensating for sound distortions in helium speech, including a plurality of audio frequency channels, each defining a particular frequency band, the center frequencies of the channels being logarithmically spaced and frequency bands together covering the helium speech frequency band to be transcoded. Each channel comprises a band-pass filter coupled to a detector, a divider dividing band-pass filter by detector output to provide a signal having the frequency delivered from the band-pass filter at a standard amplitude, and a mutliplier multiplying divider output by another channel detector output to synthesize a part of the transcoded audio signal, the different parts of the transcoded signal being combined in an adder-subtracter. The said multiplier has one input coupled from divider output in the channel of rank $i$ and the other input coupled from rectifier output in the channel of rank $i + x$, $x$ being the same for any multiplier. $x$ is selected in accordance with the proportion of helium in the gas breathed by the speaker. Each channel comprises a multiplexer selected according to $x$ for performing the adequate connections to the channel multiplier.

6 Claims, 5 Drawing Figures

VOICE TRANSCODER IN HELIUM ATMOSPHERE

Figure 1:
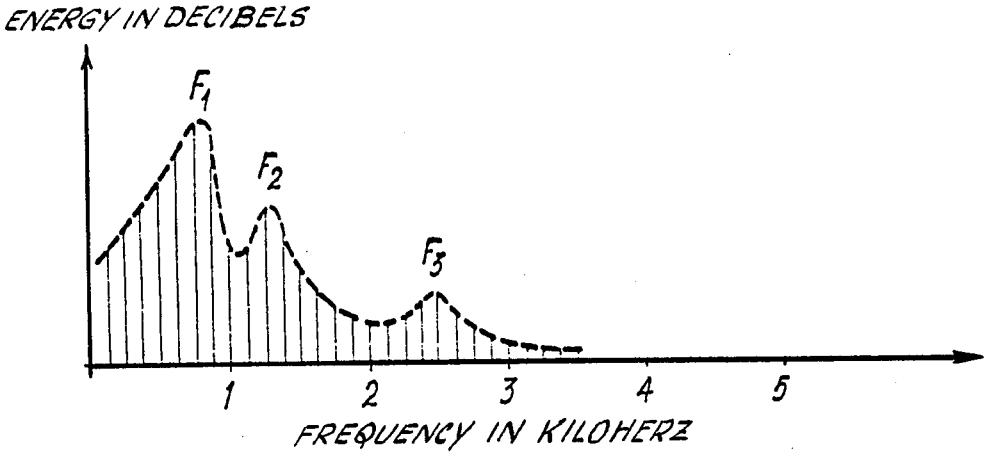

The present invention relates to a voice transcoder in a helium atmosphere.

In ocean exploration, one of the hardest problems to solve is that of means of communication between the surface and the divers. There are many phenomena which tend to make conversations between divers and the surface unintelligible. The divers' microphones operate under high pressures, which changes their amplitude-frequency response curves and their efficiency. The divers' makes create extraneous resonance frequencies which can change the voice spectrum. All kinds of mechanical vibrations are transmitted to the microphone by the mask, and this particularly interferes with the lowest frequencies. The environment in which the diver operates is very noisy: breathing, bubbles, noises of machines. These phenomena cause considerable trouble and their effects have to be mitigated. There is, however, another, very spectacular phenomenon which alone can make speech completely unintelligible. This is the "Donald Duck 38 effect, which is so-called because the well-known duck's voice was produced in an oxygen-helium atmosphere, the effect being due to the use of the oxygen-helium breathing mixture which divers use for reasons which are well known.

An object of the present invention is to produce a voice transcoder which makes it possible to reduce the disadvantages due to the "Donald Duck" effect in communication between divers and the surface.

The "Donald Duck" phenomenon can be broadly explained as follows. The sound-producing apparatus has a sound source provided, in the case of voiced sounds, by the vibration of the vocal cords, or, in another case, merely by the noisy outflow of air. The source determines the fine structure of the voice spectrum, which consists of frequency lines spaced apart from the value of the fundamental, in the case of vibration of the vocal cords, or of a white noise in the case of the outflow of air. It has been found that the fine structure of the voice spectrum is not changed by the use of helium. In addition, however, the sound source acts upon the voice duct consisting of various cavities, the dimensions of which vary depending on the sound pronounced. The shape and the position of these cavities determine the envelope of the voice spectrum. This envelope has maxima, referred to as formants, which correspond to the frequencies of resonance of the cavities. It is precisely the shape of the envelope of the voice spectrum which determines the intelligibility of a sound. As the frequencies of resonance of the cavities are changed in a helium atmosphere, the shape of the envelope of the spectrum is changed and the voice becomes more or less unintelligible.

In order to explain that the frequencies of resonance of the cavities are changed in an oxygen-helium atmosphere compared with the frequencies of resonance which are known in the oxygen-nitrogen mixture which constitutes air, it must be borne in mind that the natural frequency of a resonator is proportional to the speed of sound in the gaseous mixture in which it is immersed. The speed of sound in a perfect gas is given by the formula:

$$C = K_1 \sqrt{\gamma T/m}$$

where $K_1$ is a constant, $T$ is the temperature in degrees Kelvin, $\gamma$ is the average ratio of the specific heats at constant pressure and volume and $m$ is the molecular mass.

The natural frequency of a resonator is therefore in the following form:

$$f = K_2 \sqrt{\gamma T/m}$$

where $K_2$ is a constant.

The ratio $r_f$ of the resonance frequencies in two gases, at the same temperature, is therefore:

$$\frac{f_1}{f_2} = r_f = \sqrt{\frac{\gamma_1 m_2}{\gamma_2 m_1}}$$

When the gases consist of mixtures, it is necessary to consider somewhat more complex formulae, which are known, and, assuming air to be equivalent to a mixture of 21% oxygen and 89% nitrogen, we find, when all the calculations have been made, the following ratios $r_f$ in relation to air for different oxygen-helium mixtures used by divers depending on the depth of the dive:

| O in % | He in % | $r_f$ |
|---|---|---|
| 10.5 | 89.5 | 2.2 |
| 7 | 93 | 2.4 |
| 3.81 | 96.19 | 2.61 |
| 2 | 98 | 2.75 |
| 1 | 99 | 2.85 |
| 0 | 100 | 2.94 |

This table shows that the ratio $r_f$ is large for oxygen-helium mixtures used for dives of the order of 240m (0 : 2% He : 98%). The resonance frequencies are multiplied by 2.75, which makes speech completely unintelligible.

For the correction of the "Donald Duck" effect envisaged hereafter, we shall assume, as a first approximation, that the frequency of the fundamental of a sound does not undergo any change but that the formants undergo, in the spectrum, a shift of uniform ratio towards the higher frequencies, this ratio being greater the higher the percentage of helium.

Corrections for the "Donald Duck" effect have already been proposed in the time sphere.

Thus, it is possible to record the diver's voice to be transcoded on a magnetic tape and to listen to this recording at reduced speed. But the fundamental is transposed at the same time as the formants. Furthermore, a real-time conversation is obviously not possible. A system of this type has been disclosed as old in the U.S. Pat. No. to Dildy, 3,863,026, issued Jan. 28, 1975 (page,1, column 1, lines 29–45).

There is also a known method of correction which consists of segmenting the speech, one period of the fundamental constituting a segment. Every other segment is then eliminated and the segments which are retained are expanded in the desired $r_f$ ratio. This method, although permitting real-time conversations, has the following disadvantages. The maximum correction ratio is only two, which is not enough for dives to depths below 100 m. The segmentation is synchronous with the fundamental and it is difficult to detect and then measure the latter without delay. Lastly, the frequency of the fundamental is divided by two. This method corresponds to the subject matter of the aforesaid Dildy U.S. Pat. No. 3,863,026 and the patents cited therein.

There are still other known correction systems with non-synchronous segmentation of the fundamental and chronological expansion, but it appears that the correction obtained is not satisfactory.

It has also already been proposed to correct the "Donald Duck" effect by applying a treatment in the frequency sphere, which offers the possibility of displacing the formants in the spectrum without affecting the fundamental frequency. Thus, correction techniques are known which, at the theoretical level, are close to the technique of the channel vocoder (voice coder).

These correction techniques observe the following general principles : at the input of the system there are arrangements for analysing the voice transmitted in the helium atmosphere, at the output of the system there are arrangements for synthesising the corrected voice and, between the analysis arrangements and the synthesis arrangements, there are digital or analogue means of connection. In the analysis arrangements an analysis is made of the development of the envelope of the voice spectrum by means of a set of juxtaposed narrow band-pass filters, each being followed by an energy-measuring device. In the synthesis arrangements, on the one hand, the fine structure of the voice spectrum is reconstructed by the creation of an excitation signal containing all the frequency components of the analysed signal and, on the other hand, the envelope of the analysed signal is reconstituted with changes designed to make it intelligible. For this purpose, the excitation signal is applied to a set of synthesis filters identical with the analysis filters, preceded or followed by modulators controlled by the data supplied by the energy-measuring devices of the analysis arrangements. In order to recreate an intelligible signal, it is necessary to shift the formants of the analysed signal towards the low frequencies, that is, to control the modulator of the synthesis arrangements of rank $i$ using the data provided by the analysis arrangements of rank $i + x$, $x$ defining the extent of the shift to be made.

The signal used to produce the excitation signal is picked off directly, either at the input of the analysis arrangements or after the analysis filters, or indirectly in accordance with a measurement of the fundamental frequency of the analysis signal. This excitation signal, which is used to supply the synthesis filters, must include all the frequency components of the analysed signal in the band covered by the synthesis filters and must have a flat spectrum over the whole of this band. Such an arrangement is known from British Pat. No. 1,187,536 issued Apr. 8, 1970 to Standard Telephones and Cables Limited (page 3, lines 45–95). It is difficult to obtain such a perfect excitation signal, and this is avoided by the present invention.

It also emerges from the foregoing that these techniques of correction in the frequency sphere entail the use of two sets of band-pass filters.

A feature of the present invention is thus the possibility of providing a voice transcoder in which a correction is made in the frequency sphere, but which does not present the disadvantages of the known transcoders and which is simpler and therefore less expensive than the latter.

Another feature of the invention is the possibility of providing a voice transcoder in which use is made of a single set of band-pass filters and which does not entail the production of an excitation signal.

This means, therefore, that the number of electrical and electronic components can be divided by two at least, compared with the known equipment, as can the volume of the equipment, which can be manufactured in a more advantageous manner. Lastly, the corrected signal is not affected by imperfections in the excitation signal, as in the previous transcoders.

In summary, it is proposed to provide a novel voice transcoder for use in compensating sound distortions in helium speech by initially feeding said speech into a plurality of audio frequency channels each defining a particular frequency band, the center frequencies of which are logarithmically spaced and which together cover the helium frequency band to be transcoded. According to this invention, each such channel comprises for this purpose a band-pass filter coupled to a rectifier, a divider dividing band-pass filter output by detector output and a multiplying divider output by another channel detector output to synthesize a part of the transcoded audio signal; the different parts of this transcoded signal are combined in an adder-subtracter. Each multiplier has one input from the divider output and another input from a multiplexer, the multiplexer output being selected in accordance with the proportion of gas breathed by the speaker, the multiplexers in each channel being given the same selected value.

According to one characteristic feature of the invention, a voice transcoder is proposed which has N main channels and X supplementary channels, each main or supplementary channel having a band-pass filter, a detector and a low-pass filter, arranged in series in that order, the central frequencies of the band-pass filters of the N + X channels being logarithmically spaced and the channels being arranged in increasing order of their central frequencies, each main channel having in addition a divider and a processing circuit containing a multiplier and an individual multiplexer with $x - 1$ inputs and one output, in each main channel the output of the band-pass filter being connected, on the one hand, to the input of the detector and, on the other hand, to the dividend input of the divider, and the output of the low-pass filter being connected to the divisor input of the divider, on the one hand, and to the first input of the multiplexer, on the other hand, the X other inputs of the individual multiplexer being respectively connected to the outputs of the low-pass filters of the X main or supplementary channels which follow the main channel which has the said individual multiplexer, the output of the divider being connected to one input of the multiplier of the processing circuit, the other input of the multiplier being connected to the output of the individual multiplexer of the same processing circuit, the outputs of the multipliers of the odd main channels being directly connected to the addition input of an adder while the outputs of the multipliers of the even main channels are connected to the said addition input via an inverter, the said transducer also containing a device for the selective control of the said individual multiplexers, channels for selectively connecting in each individual multiplexer the input of the same rank with the output, the input signal of the transcoder being applied in parallel to the inputs of the band-pass filters of the main and supplementary channels, the output signal of the said adder constituting the output signal of the transcoder.

According to another characteristic feature of the invention, the said adder is an adder-subtractor, the addition input of which is directly connected to the outputs of the multipliers of the odd main channels and the subtraction input of which is directly connected to the outputs of the multipliers of the even main channels, the inverters being omitted.

According to yet another characteristic feature, instead of one divider per main channel, there is a single general divider operating chronologically, the dividend input of which is sequentially connected, by means of a first general multiplexer, to the output of the band-pass filter of each main channel and the divisor input of which is connected sequentially in synchronism, by means of a second general multiplexer, to the output of the low-pass filter of each main channel, and instead of one processing circuit per main channel it has a single general processing circuit containing a single general multiplier, of which one input is connected to the output of the said general divider and the other input is sequentially connected in synchronism to the outputs of the low-pass filters of the main and supplementary channels, the ranks of which are shifted by a selected number, between O and X, by means of a third general multiplexer, the output of the said general multiplier being connected to a general band-pass filter, the said transcoder further having a device for the selective control of the said general multiplexers in order to ensure that they operate in synchronism and in order to determine the shifting of operation of the said third general multiplexer, the input signal of the transcoder being applied, on the one hand, directly in parallel to the odd channels and, on the other hand, via an inverter to the even channels, the output signal of the general band-pass filter constituting the output signal of the transcoder.

According to further characteristic features, the selective-control device is regulated depending on the depth of the generator of the input signal or the shift of the formants to be made.

According to another characteristic feature, the selective-control device is regulated in such a way as to obtain a comprehensible output signal.

Figure 2:
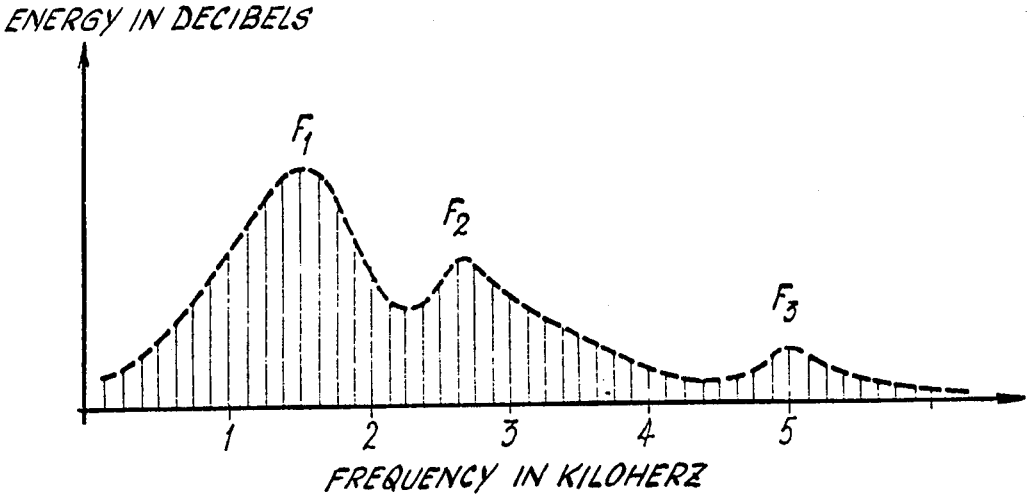
Figure 3:
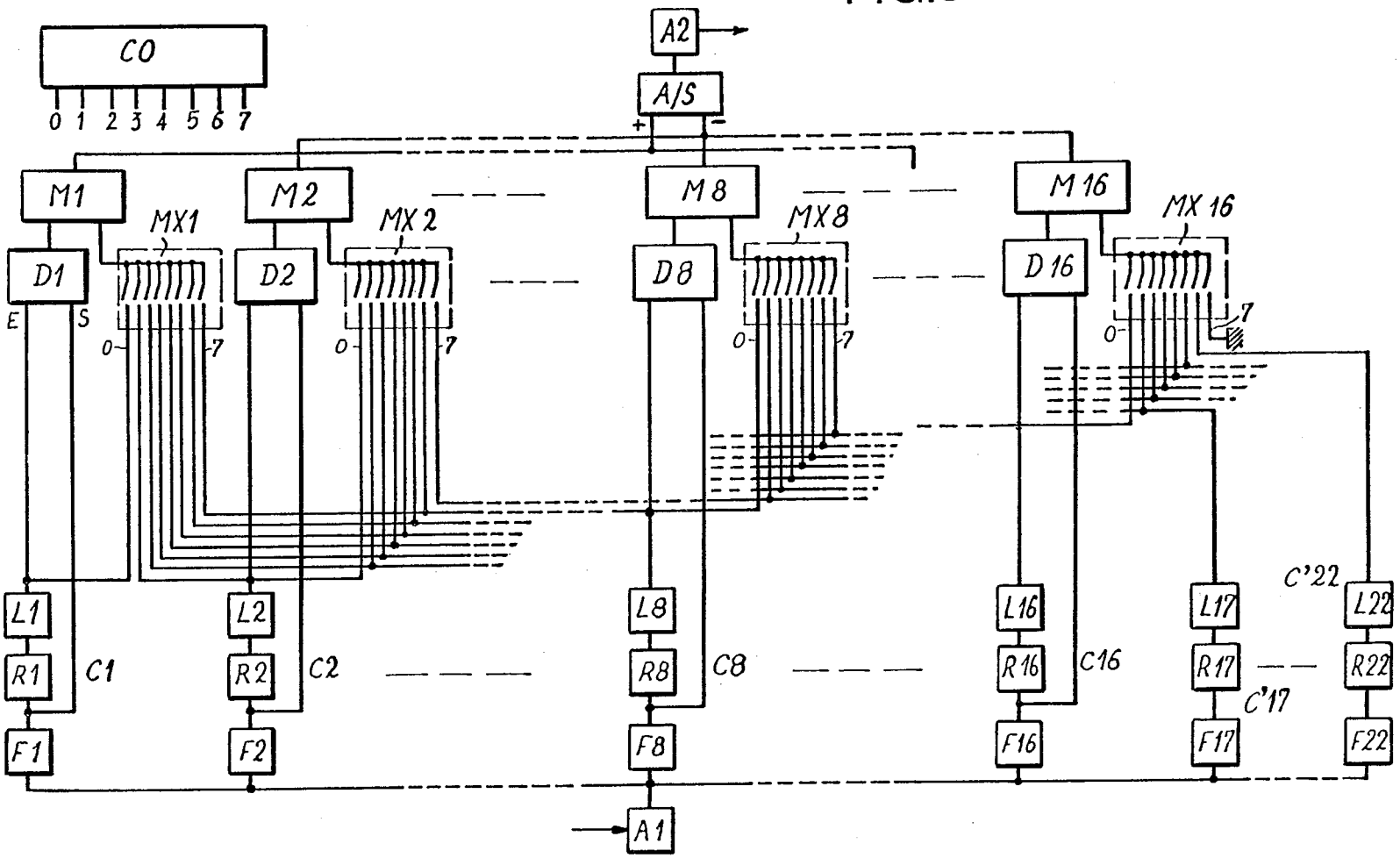
Figure 4:
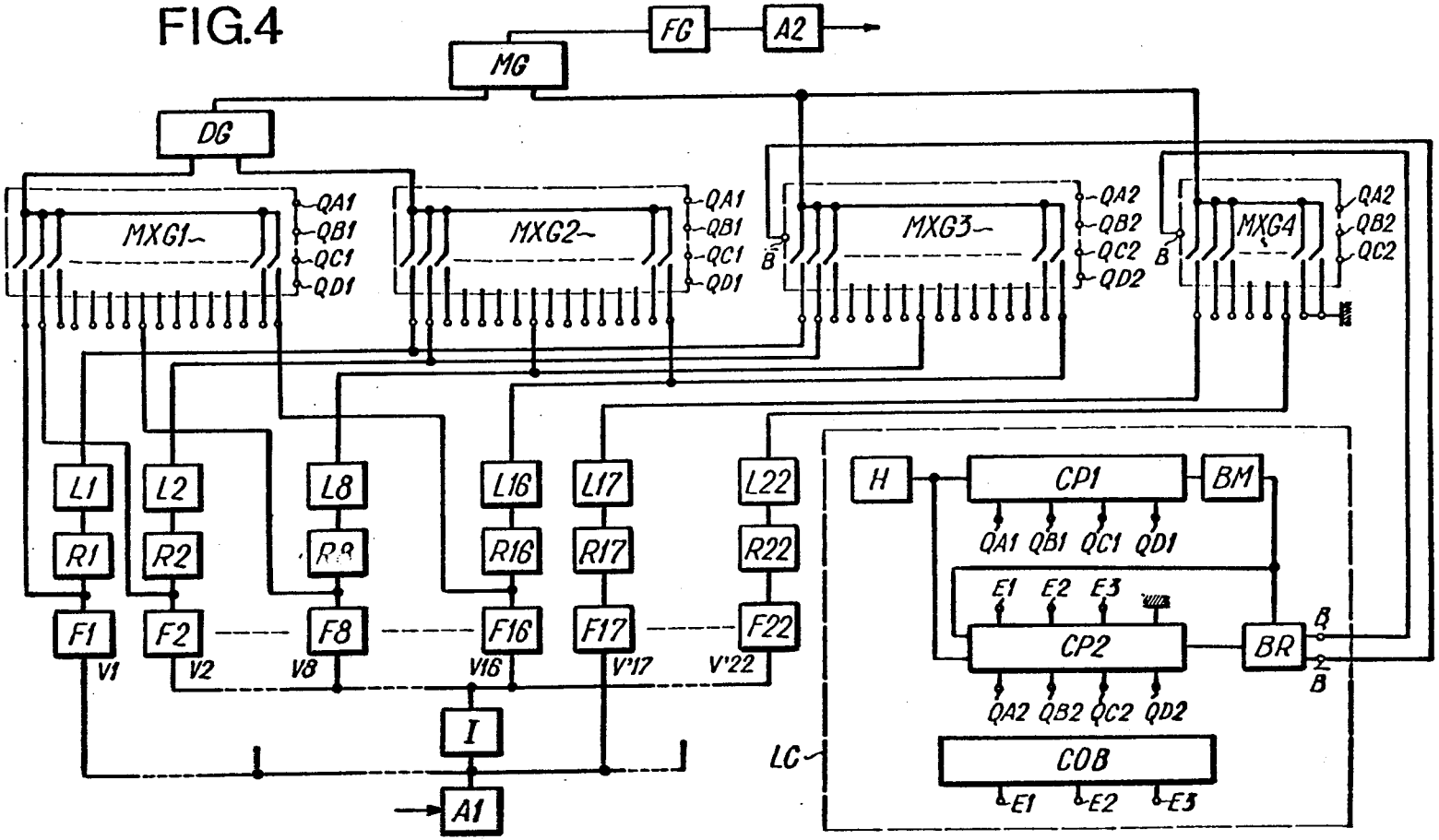
Figure 5:
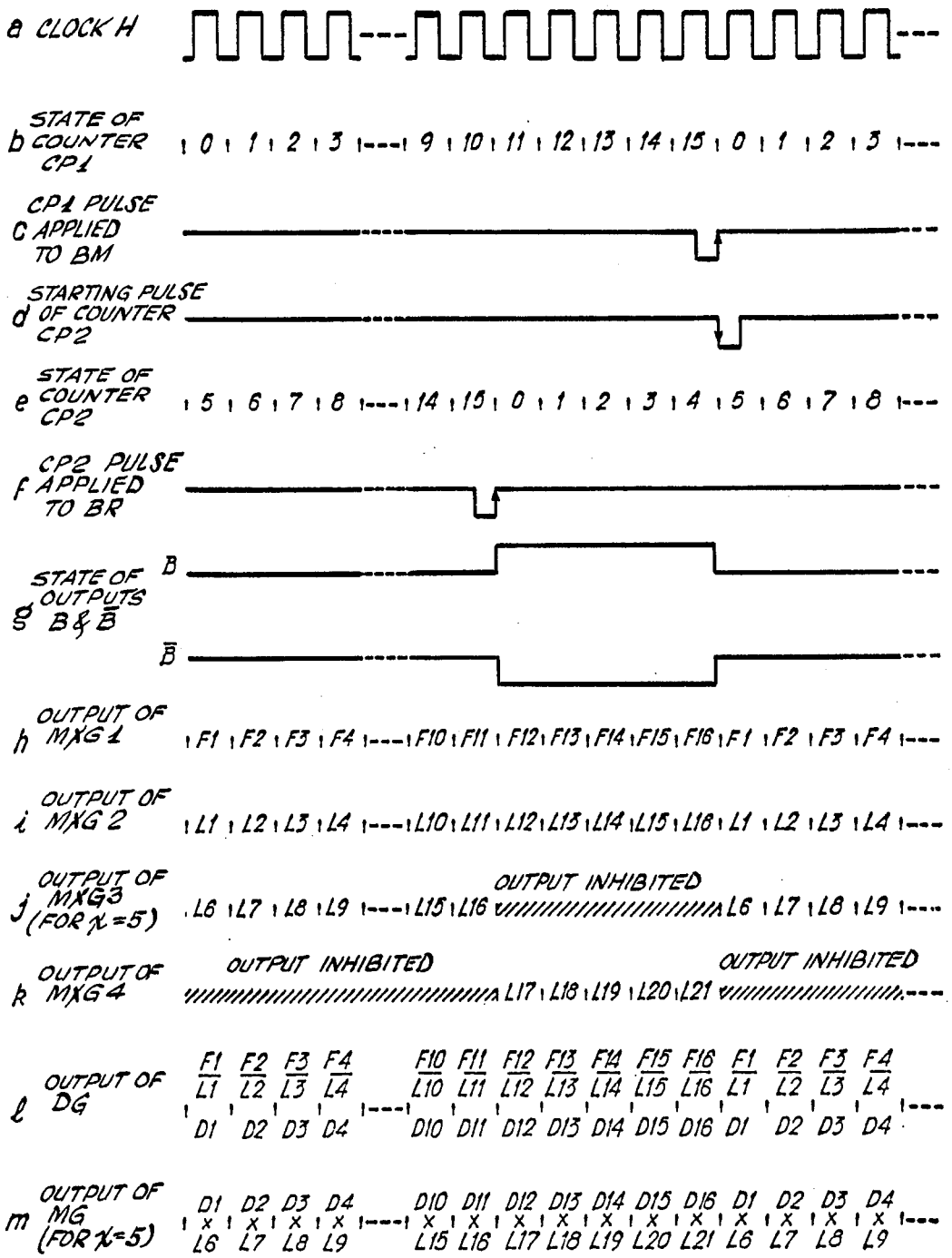

Embodiments of the invention will now be described, by way of example, with reference to the accompanying drawings, in which:

FIG. 1 represents the spectrum of the vowel "A" emitted in air,

FIG. 2 represents the spectrum of the vowel "A" emitted in a helium mixture, FIG. 3 is a block circuit diagram of a first embodiment of a voice transcoder, FIG. 4 is a block circuit diagram of a second embodiment of a voice transcoder, and FIG. 5 shows at *a* to *m* a series of wave-forms of signals and a series of time diagrams for use in illustrating the operation of the transcoder shown in FIG. 4.

An examination of FIGS. 1 and 2 shows no change in the fine structure of the voice, represented by the vertical lines, throughout the envelope, since the spacing between the lines remains constant. On the other hand, the envelope of the spectrum shown in FIG. 2 is expanded towards the high frequencies in relation to that of the spectrum in FIG. 1. In particular, the three formants F1, F2 and F3 are situated at 1.5, 2.6 and 5 kHz respectively for an "A" emitted in a helium atmosphere instead of being situated at 0.75, 1.3 and 2.5 kHz respectively, these figures being approximate. In the transducer according to the invention it is proposed to recreate a line, a harmonic of the fundamental, of frequency $f$ with the energy possessed by the signal emitted in the helium mixture in the line of frequency $a^x.f$, $a$ being the spacing ratio of the central frequencies of the band-pass filters of the channels and $x$ representing the variable shift.

In FIG. 3, there is shown a transcoder containing an input amplifier A1, 16 main channels C1 to C16, 6 supplementary channels C'17 to C'22, an adder-subtractor A/S, an output amplifier A2 and a control device CO. Each main channel C1 to C16 contains a band-pass filter F1 to F16, a detector R1 to R16, a low-pass filter L1 to L16, a divider D1 to D16, a multiplier M1 to M16 and a multiplexer MX1 to MX16. Each supplementary channel C'17 to C'22 contains a band-pass filter F17 to F22, a detector R17 to R22 and a low-pass filter L17 to L22. The 22 band-pass filters F1 to F22 are logarithmically spaced adjacent filters, the ratio *a* of the resonance frequencies of two adjacent filters being, in the example described, equal to 1.21 and all the 22 band-pass filters together covering the frequency band 250–16,000 Hz i.e., the voice frequency range of the speaker.

In each main channel C1 to C16 and in each supplementary channel C17 to C22, the output of the band-pass filter F1 to F22 is connected to the input of the detector R1 to R22, the output of which is connected to the input of the low-pass filter L1 to L22. The detectors R1 to R22 perform a double-alternation detection. The low-pass filters L1 to L22 are identical and preferably have a cut-off frequency of 100 Hz. In practice, the output signal of a low-pass filter L*i* indicates the development of energy in the frequency band which is allowed to pass by an associated band-pass filter F*i*.

The output of each of the band-pass filters F1 to F16 is also connected to the dividend input S of a respective divider D1 to D16, while the output of each of the low-pass filters L1 to L16 is connected to the divisor input E of the same respective divider. The output signal of the divider D1, for example, is a signal whose frequency is that of the signal at the input S delivered by the band-pass filter F1, the amplitude of which is equal to the amplitude of the signal at the input S divided by the value of the signal at the input E delivered by the low-pass filter L1 and proportional to the energy received in the frequency band of the filter F1. Thus the signal delivered by the divider D1 has a constant maximum amplitude and the frequency of signal at the input S.

In practice, the dividers D1 to D16 are designed to operate correctly within a dynamic of 50dB. When the input signals of a divider are at least 50dB below the designed maximum level, the normal regulation is no longer carried out and the output level of the divider tends towards zero at the same time as those of the inputs. The regulation range is preferably made adjustable.

The output of each respective divider D1 to D16 is connected to the first input of a respective multiplier M1 to M16. The second input of each multiplier M1 to M16 is connected to the respective output of one of the multiplexers MX1 to MX16 whose function is hereinafter described below.

In practice, each one of the multiplexers MX1 to MX16 has eight inputs 0 to 7 and operates in order to connect one of the eight inputs to its output. The selection of the input to be connected to the output within a respective multiplexer MX1 to MX16 is controlled by the control device CO which has eight control outputs 0 to 7 in decimal form, or three outputs in binary form. This control device represented by box CO (FIG. 3) may in its simplest form be nothing more than a rotary switch with its connections 0–7 being individual wire pairs internally and sequentially interconnecting the input-output connections within the multiplexer. Such switches are well known and may be purchased on the open market. On the other hand, the multiplexer contacts may be in the well-known form of switching transistors which again may be energized by the operation of a simple rotary switch. Such a switch per se does not form part of this invention and thus has not been illustrated in detail. Each control signal on an output of the control device CO brings about, in the sixteen multiplexers MX1 to MX16, at the same time, the connection of the input of the corresponding rank to the multiplexer output. Thus, a control signal on output 1 of the device CO brings about, in the multiplexer MX1, the connection of input 1 to the output of M1 and in the multiplexer MX2 the connection of input 1 to the output to M2, etc.

For each multiplexer MX*i*, having eight inputs 0–7, the inputs 0–7 are connected respectively to the outputs of eight low-pass filters L*i* to L($i$ + 7). Thus, the eight inputs of the multiplexer MX8 are connected respectively to the outputs of the filters L8, L9, L10, L11, L12, L13, L14 and L15. The outputs of the filters L17 to L22 are thus used, as are those of filters L1 to L16.

Thus, each multiplier M1 to M16 gives the product of the signal delivered by the respective channel divider D1 to D16 and the signal delivered by the respective channel multiplexer MX1 to MX16, the latter signal representing, depending on the selection controlled by the device CO, the energy received in the frequency band of the associated channel or of one of the seven channels immediately above. The signal delivered by a multiplier Mi therefore has the frequency of the signal delivered by a filter Fi, but an amplitude corresponding to the energy received in a filter L($i$ + $x$), where $x$ is from 0 to 7.

The outputs of the odd multipliers M1, M3, . . . , M15 are connected in parallel to the + input of an adder-subtractor A/S, while the outputs of the even multipliers M2, M4, . . . M16 are connected to the − input of the adder-subtractor A/S. This change of sign for the outputs of the even multipliers merely makes it possible to take account of the phase shifts which occur in the band-pass filters F1 to F16.

The input signal whose formants are to be displaced is applied to the input of an input amplifier A1, the output of which is connected in parallel to the inputs of the filters F1 to F22, this amplifier A1 enabling the input signal to be adapted to the many filters. The output of the adder-subtractor A/S is connected to an output amplifier A2 which delivers a signal with displaced formants with a predetermined level.

It will be clear that the transcoder which has just been described reconstitutes each frequency present at the input of the transcoder with the energy of the frequency 1.21.x.f of the same input signal, and this, in particular, displaces the formants of the input signal downwards.

The value of $x$, which the operator of the transcoder can vary by acting upon the control device CO, is chosen depending on the composition of the oxygen-helium mixture supplied to the diver, this composition itself depending on the diver's depth, the operator choosing the value of $x$. Initially, at level O, the value of $x$ is equal to 0, as the output signal of the transcoder must be identical to the signal emitted by the diver. As he goes down, the value of $x$ is modified in jumps. It is also possible to choose the value of $x$ which gives the most intelligible signal, if the operator does not know the diver's breathing conditions.

A display of $x = 7$ would be very exceptional, as the theoretical maximum is 6, which corresponds to a ratio $r_f$ of 3.12, that is, slightly above the theoretical maximum ratio for $r_f$, which is 2.94 in the case of pure helium. In the case of $x = 7$, the output of multiplier M16 is zero, the input 7 of multiplexes MX16 being at earth, and the reconstituted signal lying in the 250–4,200 Mz band.

FIG. 4 shows a variant of the transcoder shown in FIG. 3 and in which, in addition, the controls are in the binary mode. The same alpha-numeric references have been retained in FIG. 4 to designate the circuits which are identical with those in FIG. 3. The transcoder in FIG. 4 has an input amplifier A1, sixteen main channels V1 to V16, six supplementary channels V'17 to V'22, four multiplexers MXG1 to MXG4, a common divider DG, a common multiplier MG, a general filter FG functioning as an adder/subtracter, an output amplifier A2 and a control logic circuit LC. Amplifier A1 is directly connected to the odd channels, i.e. V1, V'17 etc., and through inverter I to the even channels, i.e. V2, V8, V16, V'22 etc. Each main or supplementary channel includes, connected in series, a respective band-pass filter F1 to F22, a respective detector R1 to R22 and a respective low-pass filter L1 to L22. Each main or supplementary channel has a first output consisting of the output of its low-pass filter, but each main channel also has a second output consisting of the output of its band-pass filter.

The first outputs of the main channels V1 to V16 are respectively connected in parallel to the respective inputs of the multiplexers MXG2 and MXG3. The first outputs of the supplementary channels V'17 to V'22 are connected to the respective inputs of the multiplexer MXG4. The second outputs of the main channels V1 to V16 are connected to respective inputs of the multiplexer MXG1. Each one of multiplexers MXG1 to MXG3 has sixteen inputs and one output and is controlled by a set of four control inputs receiving a control word of four binary elements, each word defining one combination out of 16 and activating in the multiplexer one gate out of sixteen connecting one input out of sixteen to the ouput. In FIG. 4, the gates are schematically represented by open contacts. The multiplexer MXG4 has only eight inputs, the last two of which are earthed, and one output; it is controlled by a set of three control inputs receiving a word of three binary elements. Furthermore, multiplexers MXG3 and MXG4 each have an inhibit input $\bar{B}$ and B, which inhibits the output of the corresponding multiplexer when it is activated. The output of the multiplexer MXG1 is connected to the dividend input of the divider DG, the divisor input of which is connected to the output of the multiplexer MXG2. The output of the divider DG is connected to the first input of the multiplier MG, the second input of which is connected in parallel to the outputs of the multiplexers MXG3 and MXG4. The output of the multiplier MG is connected to the input of a pass-band filter FG, the pass-band of which is from 250 to 5,000 Hz. The output signal from the filter FG is amplified in an output amplifier A2 which delivers a signal at a suitable level.

The logic circuit LC includes a clock H emitting clock pulses at a frequency of 200 kHz which are coupled to two counters CP1 and CP2, each of which has four stages. The counter CP1 has four binary outputs QA1, QB1, QC1 and QD1 enabling it to issue a word of four bits, assuming successively all values from 0 to 15, to the corresponding control inputs bearing the same references of the multiplexers MXG1 and MXG2. The counter CP1 also has a carry output which changes state for a predetermined time of 2.5 microseconds whenever the counter CP1 reaches the count of 15, and is connected to the input of a monostable flipflop BM which delivers a pulse of less than 5 microseconds whenever the counter CP1 reaches the count zero. The output of flipflop BM is connected, on the one hand, to the start input of the counter CP2 and, on the other hand, to the zeroing input of a bistable flipflop BR. The counter CP2 has four binary outputs QA2, QB2, QC2 and QD2 enabling it to emit, on the one hand, a word of four bits, assuming in succession all values from 0 to 15, to the corresponding control inputs bearing the same references of the multiplexer MXG3 and, on the other hand, a word of three bits via outputs QA2, QB2 and QC2, assuming all values from 0 to 7, to the corresponding control inputs bearing the same references of the multiplexer MXG4. The counter CP2 also has a carry output connected to the actuating input of the flipflop BR, the carry output being activated whenever the counter CP2 reaches the count 15. Furthermore, the counter CP2 has four pre-positioning binary inputs defining an initial count whenever the start, input of the counter, CP2 is activated by the flip-flop BM. Among these four pre-positioning inputs, only three are used, E1, E2 and E3, the fourth being connected to earth. The three inputs E1 to E3, i.e. outputs from COB, make it possible to receive a control word of three bits from a control device COB which is adjustable by the transducer operator, in a similar way to the device CO in FIG. 3 except that COB has a binary output. The flip-flop BR has two outputs B and $\overline{B}$ which are connected respectively to the inhibit inputs of the multiplexers MXG4 and MXG3.

In general, the transcoder in FIG. 4 carries out the divisions and multiplications performed by the dividers D1 to D16 and the multipliers M1 and M16 of the transcoder in FIG. 3 on a time-sharing basis by successively and selectively sampling the first and second outputs of channels V1 to V16 and V'17 to V'22. As the pass-band of filters F1 to F16 to be sampled extends up to 5,000 Hz, it is necessary to choose, in order to comply with the sampling theorem, a sampling frequency equal to or above 10 kHz, as, for instance, in the example described, a frequency of 12.5kHz. There is thus available an interval of 80 microseconds for the processing of the 16 main channels, which means that samples having a length of 80/16 = 5 microseconds have to be processed. That is why the clock H has a frequency of 12.5 kHz. There is thus available an interval of 80 microseconds for the processing of the 16 main channels, which means that samples having a length of 80/16 = 5 microseconds have to be processed. That is why the clock H has a frequency of 200 kHz. It should be noted that the multipliers and dividers at present available on the market do permit operation at these speeds.

A description will now be given of the operation of the transcoder shown in FIG. 4 with reference to the waveforms shown in FIG. 5. The waveform at *a* represents the train of pulses delivered by the clock H. The waveform at *b* represents the successive states in decimal code of the word delivered by outputs QA1 to QD1, and hence also the successive states of the gates of multiplexers MXG1 and MXG2. Consequently the divider DG carries out successively, at the rate of the clock H, the divisions performed in FIG. 3 by D1 to D16. The waveform at *c* represents the pulse applied to BM and the waveform at *d* the pulse applied to the start input of counter CP2. Consequently, on reception of the last-mentioned pulse, counter CP2 assumes the value indicated by its inputs E1 to E3. In the example described, it is assumed that E1 to E3 represents, in decimal code, the digit 5 defined by the operator of the control device COB in order to displace the formants of the input signal downwards. In other words, the value of *x* indicated in connection with the transducer in FIG. 3 is chosen here, by way of example, as 5. The waveform at *e* represents the successive stages in decimal code of the word delivered by outputs QA2 to QD2, and hence also the successive states of the gates of the multiplexers MXG3 and MXG4. The waveform at *f* represents the carry pulse applied by the counter CP2 to BR and the waveforms at *g* the states of the outputs B and $\overline{B}$ of the flip-flop BR. It will be seen that, during the states 0 to 4 of the word delivered by the counter CP2, the output of the mutliplexer MXG3 is inhibited while, during the states 5 to 15 of the word delivered by the counter CP2, the output of the multiplexer MXG4 is inhibited. It is also evident that when the gate O of the multiplexers MXG1 and MXG2 is closed, the gate 5 of the multiplexer MXG3 is closed. Thus, at, that moment, the multiplier MG multiplies the output signal of the divider DG corresponding to the channel V1 by the output signal of the multiplexer MXG3, i.e. the energy of the channel V6. We thus have again, on a time-sharing basis, the operation of the transducer in FIG. 3.

The waveforms at *h* to *m* represent the identities of the signals at the outputs of the multiplexers MXG1 to MXG4, of the divider DG and the multiplier MG. In particular, the waveform *m* represents the successive samples corresponding to the outputs of the multipliers M1 to M16 in FIG. 3. It should be noted, however, that these samples can be directly filtered in the filter FG in order to give the output signal, because there is provided, between the inputs of the even channel V2, V4 . . . V'22 and the input amplifier A1, an inverter (or 180° phase shifter) circuit I in order to take into account the parity of the channel.

As a variant it would also be possible, for example, to substitute for the two multiplexers MXG3 and MXG4 a single multiplexer with more than twenty two inputs and to replace the four-stage counter CP2 with a five-stage counter, in order to obtain a result equivalent to that obtained with the transducer in FIG. 4.

It should be noted that the transducer in FIG. 4 presents the advantage, over that in FIG. 3, of needing only one divider and one multiplier instead of thirty two circuits of this type. As these circuits are expensive and the logic circuit CL is relatively simple, a particularly large cost reduction is thus obtained.

I claim:

1. A voice transcoder for compensating for sound distortions in helium speech, said transcoder having N main channels and X supplementary channels, each main and supplementary channel comprising a band-pass filter, a rectifier and a low-pass filter serially connected, the central frequencies of the band-pass filters of the N+X channels being spaced logarithmically, and the N+X channels being ranked in the increasing order of said central frequencies, each main channel comprising, in addition, a divider, a multiplier, and a multiplexer with X+1 inputs and one output in which, in each main channel the band-pass filter output is connected to the divider dividend input, and the low-pass filter output is connected to the divider divisor input and the first input of the multiplexer, the other X inputs of said multiplexer being respectively connected from low-pass filters belonging to the X main or supplementary channels immediately ranked beyond the concerned main channel, the divider output being connected to one input of the multiplier and the multiplexer output being connected to the other input thereof, output control means for delivering the transcoded voice signal and means connecting the outputs of said odd and even channel multiplier to said output control means, further control means for selectively connecting in each multiplexer the same ranked multiplexer inputs to the multiplexer output, an input voice signal, and means to apply said input voice signal in parallel to the main and supplementary band-pass filter inputs, whereby said output control means delivers the transcoded voice signal.

2. Voice transcoder according to claim 1, in which said output control means is an adder/subtracter, and in which the outputs of said odd channels are connected to the addition input of said adder/subtracter, and the outputs of said even channels are connected to the subtraction input thereof.

3. Voice transcoder according to claim 1, in combination with an inverter connected between said input voice signal, and the even band-pass filter inputs.

4. Voice transcoder according to claim 3, in combination with a divider common to all main channels operating chronologically, a first common multiplexer sequentially connecting each main channel band-pass filter output to the common divider dividend input, a second common multiplexer sequentially connecting each main channel low-pass filter output to the common divider divisor input, a common multiplier having one input connected to the output of said common divider, a third common multiplexer sequentially connecting the low-pass filter outputs of the main or supplementary channels to the second input of said common multiplier, whereby said third multiplier operates a rankshifted channel and in which said further control means acts upon said third multiplexer for selecting the rank shift, clock means for chronologically controlling the output signals of said multiplexers to said common divider and a common low-pass filter having its input connected to the output of said common multiplexer whereby the output of said low-pass filter delivers the transcoded voice signal.

5. Voice transcoder according to claim 1, in which said further control means is adjusted in accordance with the low water depth of the input voice signal.

6. Voice transcoder according to claim 1, in which said further control means is operated in accordance with the displacement of the formants to be effected.

* * * * *